US011576475B2

(12) United States Patent
Boatman-Tate

(10) Patent No.: US 11,576,475 B2
(45) Date of Patent: Feb. 14, 2023

(54) HAIR STYLING TOOL

(71) Applicant: Wyconnda Boatman-Tate, Chicago, IL (US)

(72) Inventor: Wyconnda Boatman-Tate, Chicago, IL (US)

( * ) Notice: Subject to any disclaimer, the term of this patent is extended or adjusted under 35 U.S.C. 154(b) by 127 days.

(21) Appl. No.: 17/138,767

(22) Filed: Dec. 30, 2020

(65) Prior Publication Data

US 2021/0196022 A1 Jul. 1, 2021

Related U.S. Application Data

(60) Provisional application No. 63/090,200, filed on Oct. 10, 2020, provisional application No. 62/965,162, filed on Jan. 23, 2020, provisional application No. 62/960,921, filed on Jan. 14, 2020, provisional application No. 62/955,340, filed on Dec. 30, 2019.

(51) Int. Cl.

| | |
|---|---|
| ***A45D 24/14*** | (2006.01) |
| ***A41D 13/08*** | (2006.01) |
| ***A46B 5/04*** | (2006.01) |

(52) U.S. Cl.

CPC ..... *A45D 24/14* (2013.01); *A46B 5/04* (2013.01); *A41D 13/087* (2013.01)

(58) Field of Classification Search

CPC ..... A45D 24/14; A45D 24/38; A45D 24/10; A44C 9/003; A41D 19/0013; A41D 13/087; A47L 13/18; A46B 5/04

USPC ..... D28/21, 31

See application file for complete search history.

(56) References Cited

U.S. PATENT DOCUMENTS 1,388,618 A * 8/1921 Stein ..... A41D 19/01517 2/21
2,154,336 A * 4/1939 King ..... A45D 24/14 132/149
2,180,394 A * 11/1939 Bowyer ..... A45D 24/14 132/156
2,297,714 A * 10/1942 Nesbitt ..... A46B 5/04 132/149
2,467,975 A * 4/1949 Manuelhollen ..... A45D 2/42 132/161
2,526,128 A * 10/1950 Grant ..... A45D 24/14 132/148
2,608,975 A * 9/1952 Shannon ..... A46B 5/04 132/161
2,821,203 A * 1/1958 Kesterson ..... A45D 24/10 132/122
3,166,081 A * 1/1965 Larson ..... A45D 24/10 132/148

(Continued)

*Primary Examiner* — Nicholas D Lucchesi
*Assistant Examiner* — Jennifer Gill
(74) *Attorney, Agent, or Firm* — Cionca IP Law P.C.; Marin Cionca

(57) ABSTRACT

A hair styling tool having a comb component and sectioning component is provided. The hair styling tool also may also have a glove component. The glove component may protect a stylist's skin from heat and burns during the styling process, the comb component may allow a stylist smooth and detangle hair, and the sectioning component may allow a stylist easily and precisely section hair to be styled. This hair styling tool can be used for flat ironing, wand curling, blow-drying and hot combing hair to protect the user's hand and allow for more time efficient hair styling.

7 Claims, 7 Drawing Sheets

(56) References Cited

U.S. PATENT DOCUMENTS

| | | | | |
|---|---|---|---|---|
| 4,507,804 | A * | 4/1985 | Consigny | A41D 13/087 2/21 |
| 7,574,748 | B2 * | 8/2009 | Fisher | A41D 19/01588 2/160 |
| 8,479,749 | B2 * | 7/2013 | Randolph | A46B 5/04 2/21 |
| 11,083,271 | B2 * | 8/2021 | Akyurt | A45D 24/04 |
| D959,054 | S * | 7/2022 | Boatman-Tate | D28/25 |
| 2009/0038159 | A1 * | 2/2009 | White | A47J 43/288 30/279.6 |
| 2017/0119125 | A1 * | 5/2017 | Davis | A41D 13/081 |
| 2017/0355090 | A1 * | 12/2017 | Spencer | B26B 21/4006 |
| 2020/0170318 | A1 * | 6/2020 | Davis | A45D 24/38 |

* cited by examiner

HAIR STYLING TOOL

CROSS-REFERENCE TO RELATED APPLICATIONS

This application claims the benefit of U.S. Provisional Application No. 62/955,340, filed Dec. 30, 2019, of U.S. Provisional Application No. 62/960,921, filed Jan. 14, 2020, of U.S. Provisional Application No. 62/965,162, filed Jan. 23, 2020, and of U.S. Provisional Application No. 63/090,200, filed Oct. 10, 2020, which are hereby incorporated by reference, to the extent that they are not conflicting with the present application.

BACKGROUND OF INVENTION

1. Field of the Invention

The invention relates generally to hair styling tools and more particularly to a versatile three-in-one hair styling tool which allows a stylist to easily section and style hair while also preventing burns.

2. Description of the Related Art

Currently, there are a number of solutions for hair styling tools. Some of these solutions attempt to address hair styling issues relating to heat styling tools. But these stand-alone solutions fail to completely meet the needs of the industry as growth, change and the need for versatility within the industry require suitable multifunctional hairstyling options to optimize the styling experience. While some solutions attempt to prevent burns, but these solutions are unable to meet the needs of the industry because they are often restrictive, bulky and impede the styling process. Still, other solutions seek to aid a stylist in hair sleeking applications, but these solutions also fail to meet industry needs because they fail to effectively prevent heat damage and burns to the skin of the stylist when applying heat to the hair during the heat styling process. Additionally, the number of styling tools a stylist must switch between to achieve hair styles can be cumbersome and time consuming.

Therefore, there is a need to solve the problems described above by proving a device and method for compact, versatile hair styling which allows a stylist to maintain maximum dexterity while protecting from burns.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a styling tool for styling hair is provided, the tool having a glove component for covering a user's finger, a comb component for smoothing hair, and a sectioning component for sectioning hair. Thus, an advantage is more efficient hair styling. Another advantage is the user decreases the risk of getting burned by hot tools because of the glove component protecting their skin. Additionally, another advantage is being able to quickly and easily use all the components for styling instead of having to put down each item to grab a different tool as needed.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
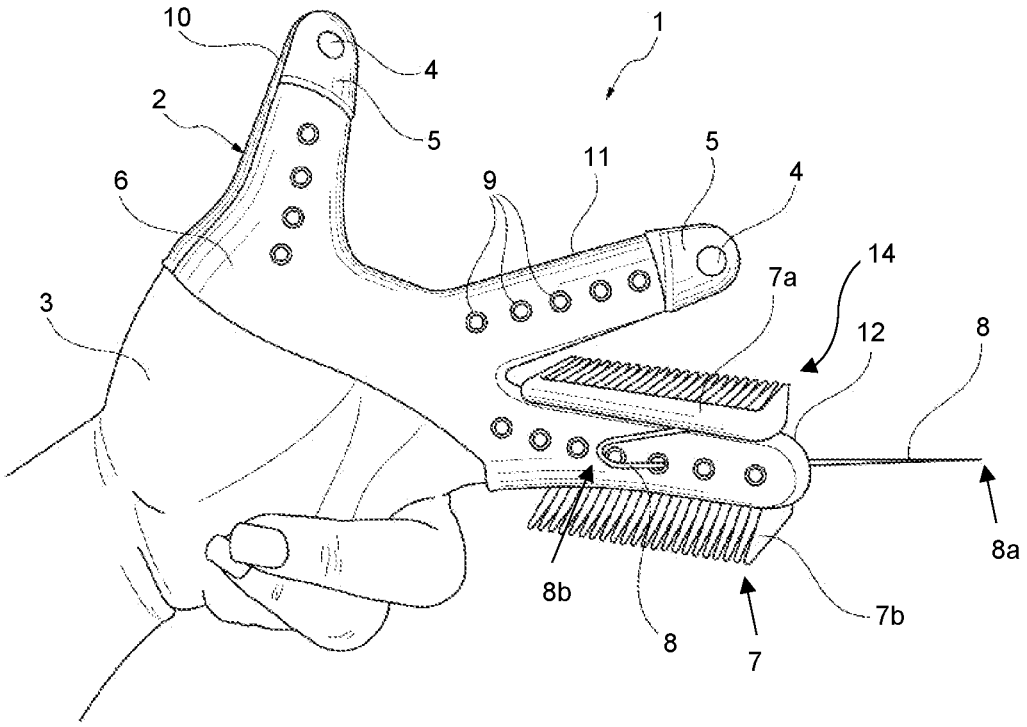
FIGS. 1*a*-1*b* illustrate the perspective anterior view of exemplary embodiments of a 3-in-1 hair styling tool, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 1B:
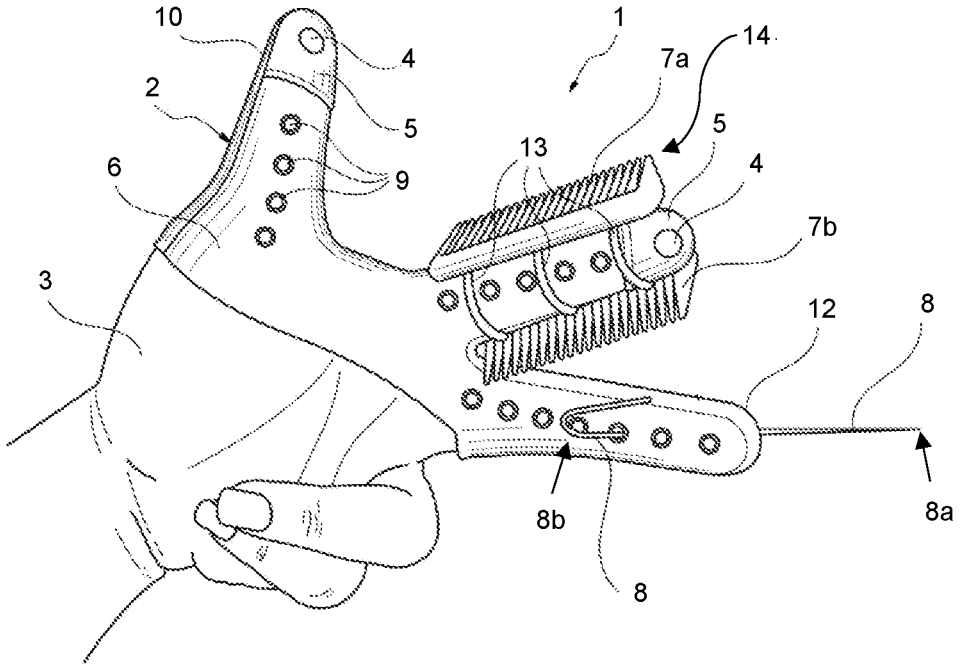

FIGS. 1*a*-1*b* illustrate the perspective anterior view of exemplary embodiments of a 3-in-1 hair styling tool ("styling tool," "hair styling tool," "styling device") 1, according to an aspect. The 3-in-1 hair styling tool 1 may comprise three components: a glove component 2, a comb component 14, and a sectioning component 8. As disclosed in greater detail hereinafter, the glove component 2 may protect a stylist's skin from heat and burns during the styling process, the comb component 14 may allow a stylist smooth and detangle hair, and the sectioning component 8 may allow a stylist easily and precisely section hair to be styled. It should be noted that the components of the hair styling tool 1 may be integrated such that the components may be retractable, removable and or interchangeable. Additionally, it should be noted that the hair styling tool 1 components may be manufactured of materials which allow the styling tool 1 to be light weight, flexible, and machine washable, such as but not limited to mesh, polyester, vinyl, nylon, silicone, and steel.

A glove component 2 may comprise a glove body 6 and protective fingertips 5, wherein both the glove body 6 and protective fingertips 5 are made of a material which protects a stylist's skin from burns, such as silicon, for example. The protective fingertips 5 may be attached to the glove body 6 or be removable. Having removable protective fingertips 5 may be advantageous to allow the styling tool 1 to be used by many stylists, for example, with different hand sizes. As an example, shown in FIGS. 1*a* and 1*b*, the glove body 6 may be a partial glove which may cover a stylist's thumb 10, index finger 11 and middle finger 12. It should be understood that in alternate embodiments the glove body 6 may a partial glove covering different portions of a stylist's hand or a full glove covering a stylist's entire hand. The glove body 6 may have a plurality of holes 9 disposed along the anterior portion of the thumb 10, index finger 11, and middle finger 12, which can be used by a stylist to choose the position of the sectioning component 8, for example. Additionally, each protective fingertip 5 may or may not have a hole 4 disposed and centered on the anterior portion the protective fingertips 5.

In one embodiment, shown by FIG. 1*a*, the comb component 14 may comprise two sets of teeth 7*a* and 7*b*, which are attached to the glove body 6 on the middle finger 12, wherein one set of teeth 7*a* faces the posterior (top) portion of a hand 3 and the other set of teeth 7*b* faces the anterior (palm) portion of a hand 3. In another embodiment, shown by FIG. 1*b*, the comb component 14 may be detachable from the glove body 6 and secured to a stylist's finger via a plurality of rings 13. Again, the comb component 14 may have two sets of teeth 7*a* and 7*b*, which face the posterior and anterior portions of a hand, respectively. The detachable comb component 14 may be advantageous as it can allow a stylist the flexibility to choose which finger to secure the comb component 14 to. This embodiment also may allow the stylist to use the comb component 14 on its own. Alternate embodiments of a comb component 14 are disclosed in greater detail hereinafter. It should be understood that the comb component 14 may have one or more sets of teeth 7 which may face the anterior portion of a hand, the posterior portion of a hand, or a combination thereof. Additionally, it should be understood that the sets of teeth 7 can have various dimensions, i.e., length, width, height, number of teeth, etc., and that the teeth can have various different shapes, i.e., triangle, cylinder, rectangle, etc. It should also be understood the plurality of sets of teeth 7 used for the comb component 14 can have the same dimensions and shapes or differing dimensions and shapes. Additionally, it should be understood that the sets of teeth 7 may be made of various materials, such as synthetic or natural materials, for example, synthetic or natural bristles, etc.

As shown in FIGS. 1*a* and 1*b*, the sectioning component 8 of the 3-in-1 hair styling tool 1 may be a pin with a pointed tip 8*a* and a hook shaped end 8*b*. As an example, the sectioning component 8 may be detachable from the glove component 2 and the comb component 14 or the sectioning component 8 may be integrated into the glove component 2 or the comb component 14, as disclosed in greater detail hereinafter. In the embodiments shown by FIGS. 1*a* and 1*b*, a stylist may utilize the sectioning component 8 by inserting the tip of the pin 8*a* into one of the plurality of holes 9 disposed along the anterior portions the thumb 10, index finger 11, or middle finger 12 of the glove body 6, sliding the tip of the pin 8*a* between the finger and the glove body, and out through the tip of the glove component 2. As an example, there may be a hole 4 in the glove component disposed at the protective fingertips 5, or there may be no hole 4. In an embodiment with a hole, the tip of the pin 8*a* can be inserted out of the hole 4. In an embodiment with no hole, the glove component may be made of a material, for example cotton, such that the tip of the pin 8*a* can be inserted through the tip of the glove component creating a permanent hole.

Figure 2:
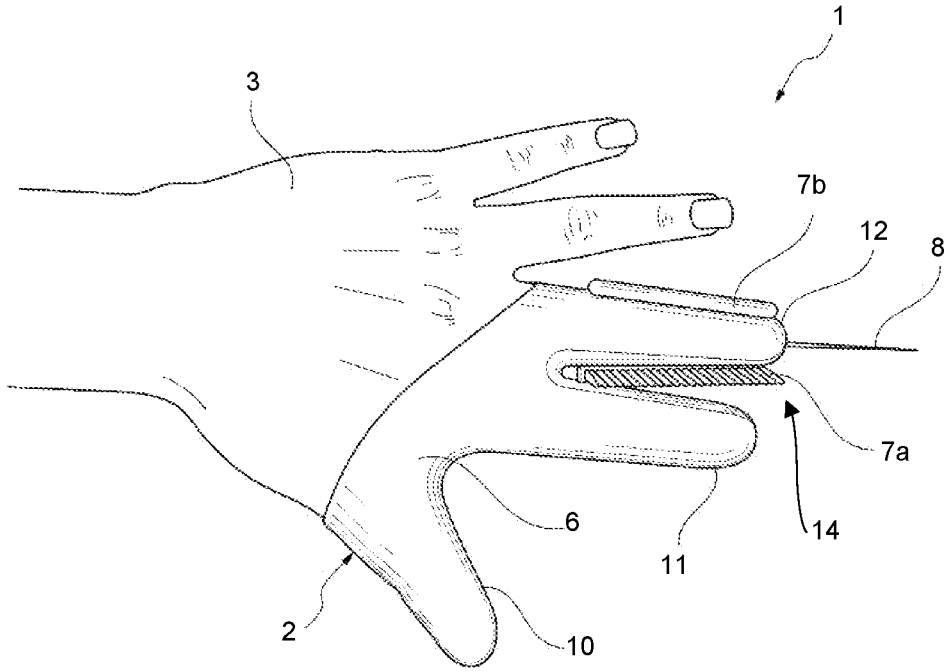
FIG. 2 illustrates the perspective posterior view of an exemplary embodiment of a 3-in-1 hair styling tool, according to an aspect.

FIG. 2 illustrates the perspective posterior view of an exemplary embodiment of a 3-in-1 hair styling tool ("styling tool") 1, according to an aspect. As an example, the embodiment of a hair styling tool 1 shown in FIG. 2 may be the same as the embodiment shown in FIG. 1*a*. As shown and described herein, the styling tool 1 may comprise a glove component 2, comb component 14, and sectioning component 8. In this exemplary embodiment, the glove body 6 covers the thumb 10, index finger 11, and middle finger 12 of a stylist's hand 3. Additionally, the comb component 14 comprises two sets of teeth 7*a* and 7*b*, which are attached to the glove body 6 on the stylist's middle finger 12. As shown, the sectioning component 8 is also secured to the glove body 6 on the stylist's middle finger 12.

As an example, a stylist may utilize the following method to operate the 3-in-1 hair styling tool 1: (1) section the hair using the sectioning component 8; (2) separate and smooth the hair strands with the attached teeth sets 7*a* and 7*b*; and (3) apply heat to the hair while the glove component 2 to protects the skin from burns. It should be understood that these aforementioned steps may be alternated according to the needs of the stylist. Additionally, the materials used to manufacture the device may be altered to achieve ultimate styling efficiency. Furthermore, this method may be adjusted to be completed without the use of the sectioning component 8.

Figure 3:
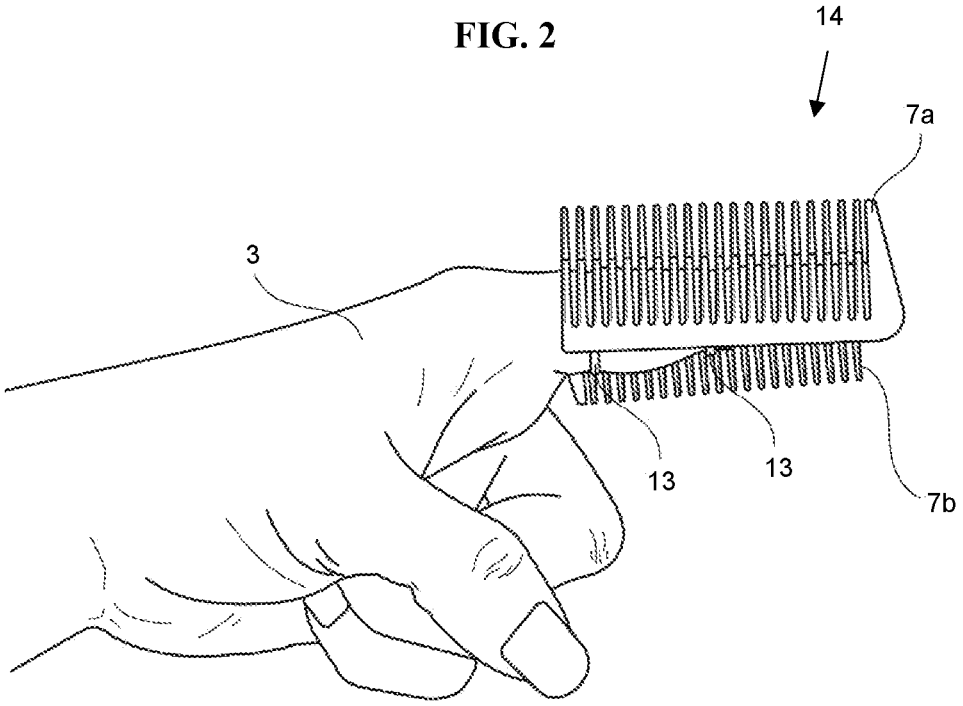
FIG. 3 illustrates a side view of an exemplary embodiment of a comb component, according to an aspect.

FIG. 3 illustrates a side view of an exemplary embodiment of a comb component 14, according to an aspect. As shown, this exemplary embodiment of a comb component 14 comprises two sets of teeth 7*a* and 7*b*, which face the anterior and posterior portions of the hand 3, respectively, and a plurality of rings 13. As an example, the plurality of rings 13 may be two rings, disposed at the base of the comb component 14 and at the middle of the comb component 14. In another example, the plurality of rings 13 may be three rings 13, disposed at the base of the comb component 14, the middle of the comb component 14, and the tip of the comb component 14. As shown, the comb component 14 may be detachable from the other components of the hair styling tool 1, such that the comb component 14 may be secured to any finger, used alone, and or in conjunction with the other components of the hair styling tool.

Figure 4A:
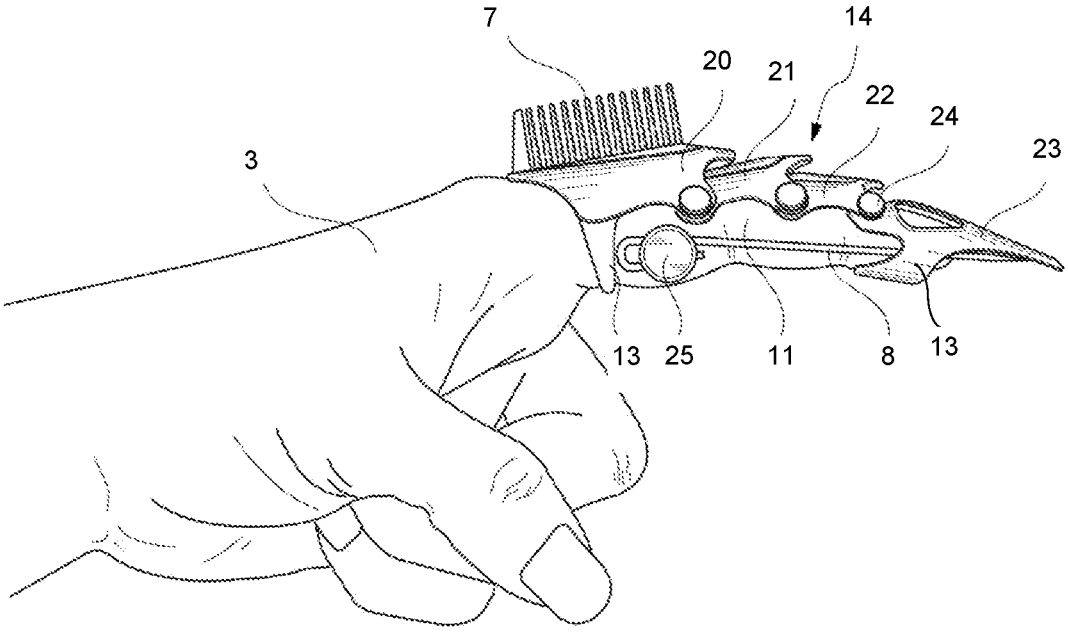
FIGS. 4*a*-4*b* illustrate the side and posterior views of an alternate embodiment of a comb component, according to an aspect.
Figure 4B:
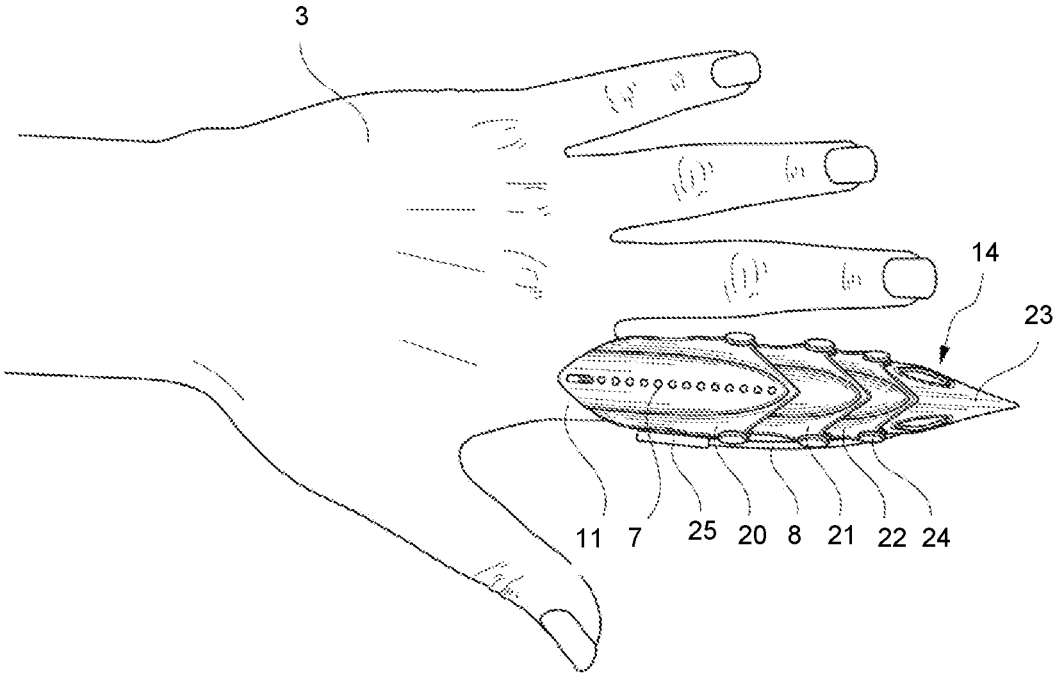

FIGS. 4*a*-4*b* illustrate the side and posterior views of an alternate embodiment of a comb component 14, according to an aspect. As shown in FIGS. 4*a* and 4*b*, the comb component 14 may comprise one set of teeth 7, two rings 13, four segments 20-23, and pins 24. As shown, the set of teeth 7 may be secured to the base segment 20 and have a length which is approximately half the length of a finger 11. Additionally, the comb component of FIGS. 4*a* and 4*b* may have two rings 13, disposed on the base segment 20 and the tip segment 23, which secure the comb component to a stylist's finger 3. In this embodiment of the comb component 14, there are four segments 20-23 which are joined together with pins 24 on either side of each segment joint, such that the segments 20-23 can bend and articulate with the movement of a stylist's finger 11. As an example, the tip segment 23 may terminate in a triangular shape. Alternatively, the tip segment 23 may terminate in any various other shapes, such as but not limited to a squared, rounded, or ovular shape. The segmented design disclosed herein is advantageous as it allows a stylist to maintain their dexterity when using the 3-in-1 hair styling tool 1.

As an example, shown by FIGS. 4*a* and 4*b*, the sectioning component 8 may be integrated into the comb component 14 via the pin 25 disposed on the side of the finger 11. As shown, the sectioning component 8 can be inserted between a stylist's finger 11 and the tip segment 23, such that the stylist can use their thumb to manipulate the sectioning component 8.

Figure 5A:
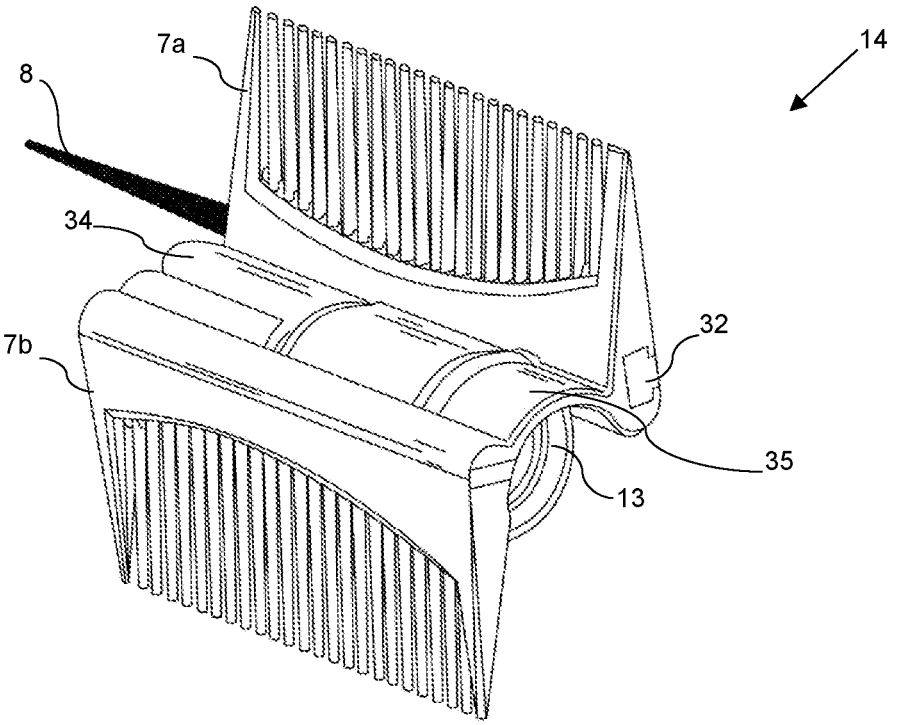
FIGS. 5*a*-5*d* illustrate another embodiment of a comb component, wherein the sectioning component is integrated with the comb component and the sectioning component is shown in an extended position, according to an aspect.
Figure 5B:
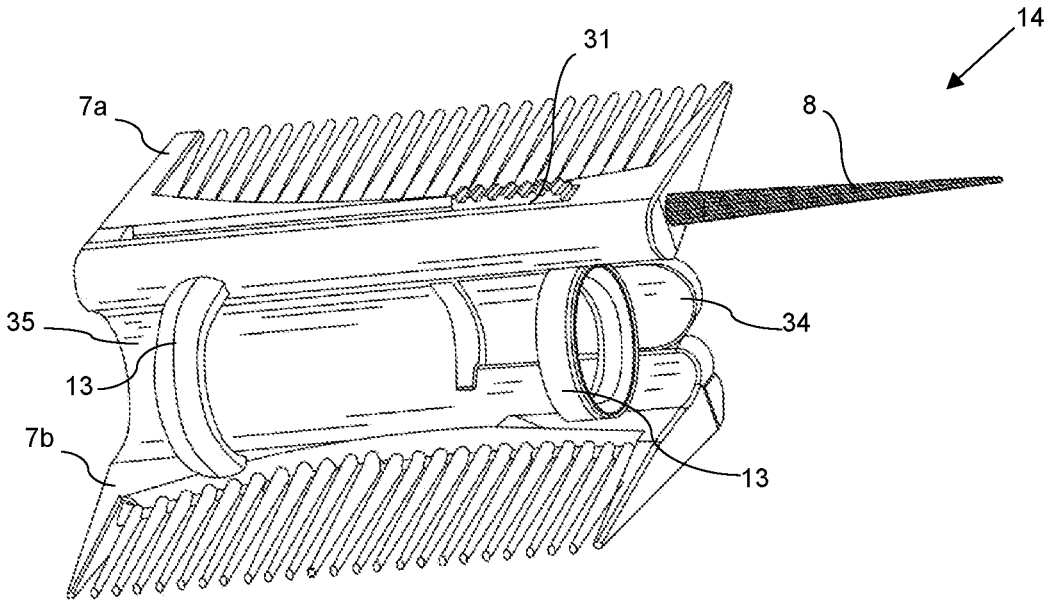
Figure 5C:
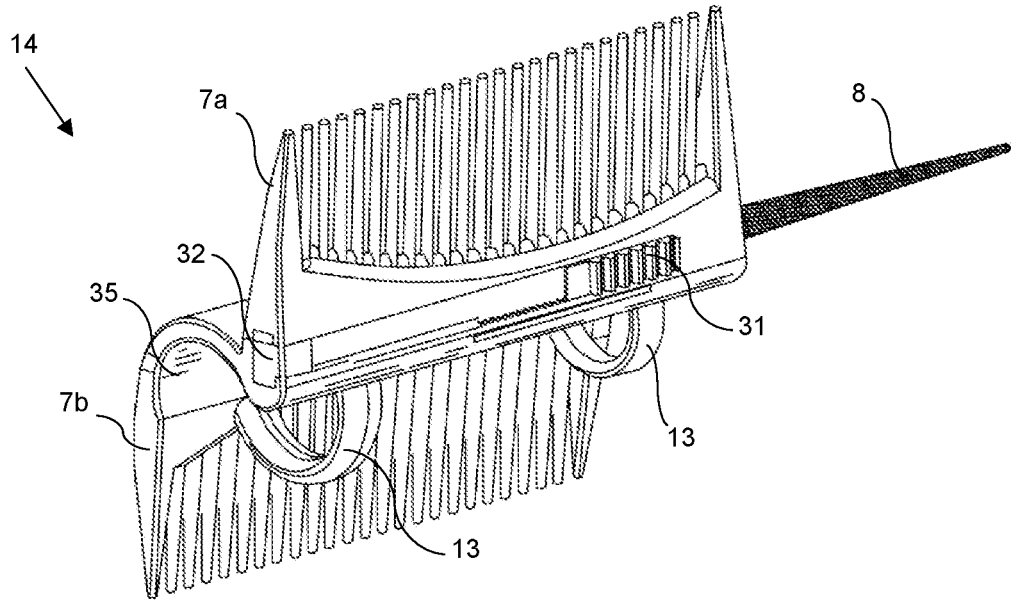
Figure 5D:
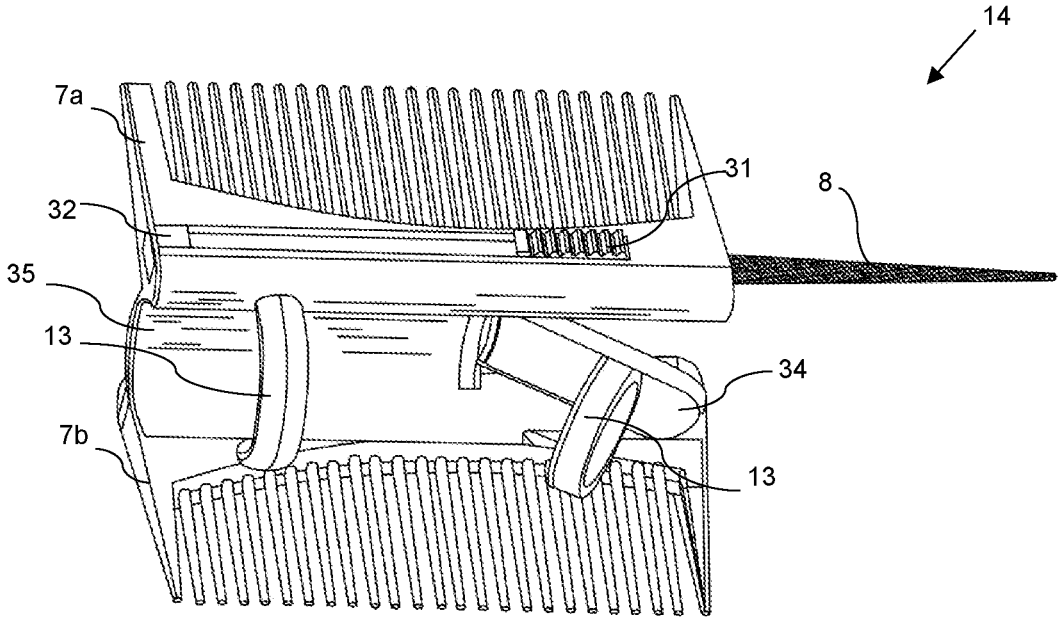

FIGS. 5*a*-5*d* illustrate another embodiment of a comb component 14, wherein the sectioning component 8 is integrated with the comb component 14 and the sectioning component 8 is shown in an extended position, according to an aspect. FIG. 5*a* illustrates a perspective rear view of the inner side of the comb component 14. FIG. 5*b* illustrates a perspective anterior view of the comb component 14. FIG. 5*c* illustrates a perspective rear view of the outer side of the comb component 14. FIG. 5*d* illustrates another perspective anterior view of the comb component 14, wherein the tip segment is in a bent position.

The comb component of FIGS. 5*a*-*d* may comprise a base segment 35, a tip segment 34, two rings 13 disposed on the base segment and the tip segment 34, and two teeth sets 7*a* and 7*b* disposed on the base segment 35. As shown, the teeth set 7*a* may be facing anterior and teeth set 7*b* may be facing posterior. As disclosed hereinbefore, the rings 13 can be used to secure the comb component 14 to a stylist's finger and the segments 34, 35 allow a stylist to maintain dexterity while styling hair.

Figure 6A:
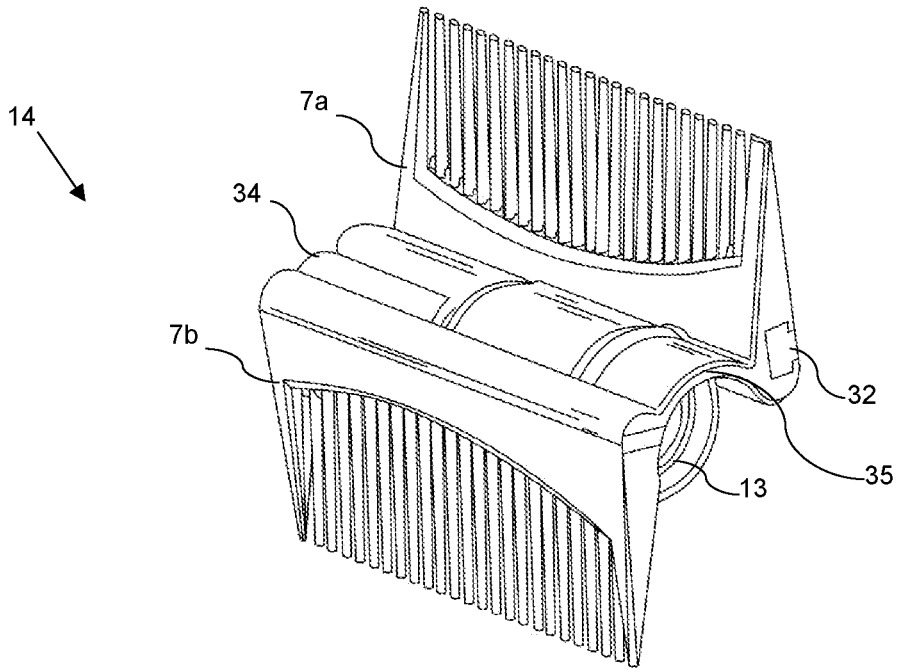
FIGS. 6*a*-6*d* illustrate an embodiment of a comb component, wherein the sectioning component is integrated with the comb component and the sectioning component is shown in a retracted position, according to an aspect.
Figure 6B:
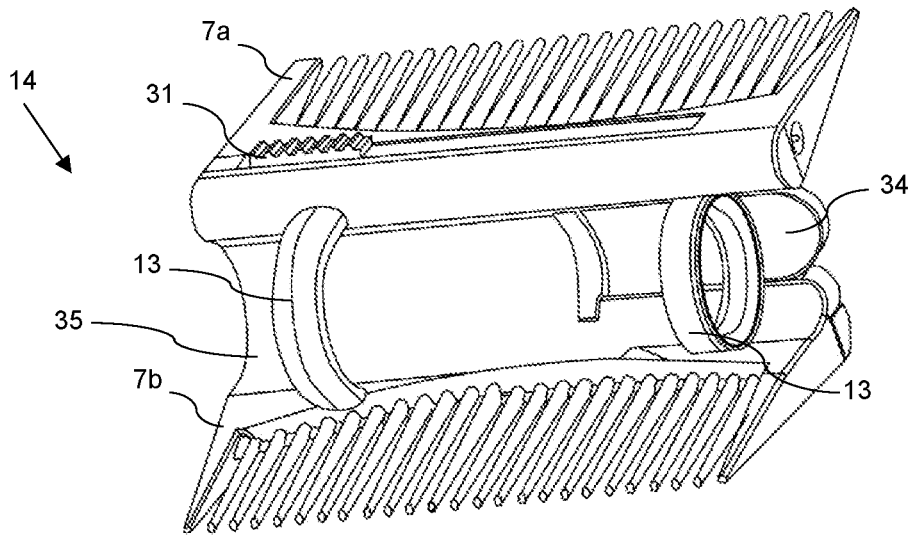
Figure 6C:
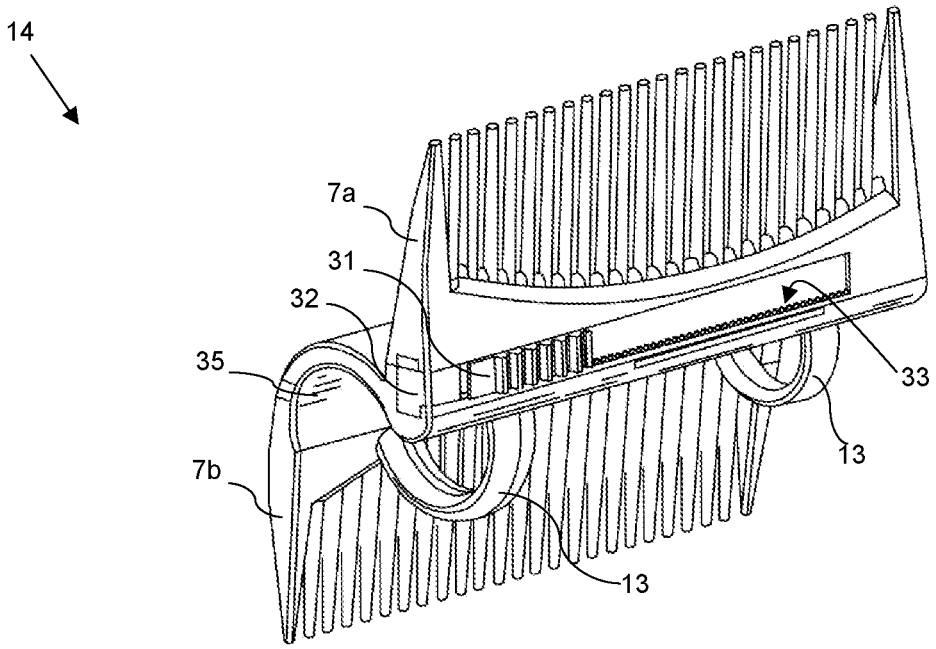
Figure 6D:
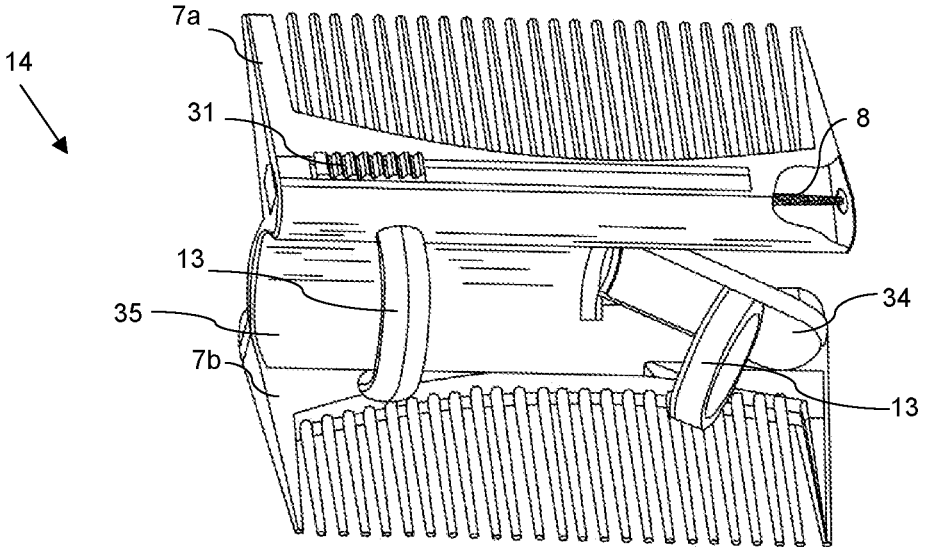

In this embodiment of a comb component 14 has an integrated sectioning component 8, wherein the sectioning component can be extended and retracted via a rachet switch 31. As shown, the comb component of FIGS. 5*a*-5*d* may have a hollow compartment 32 into which a sectioning component 8 can be placed. The sectioning component 8 can then be extended via sliding the ratchet switch 31 towards the tip of the comb component 14, as shown in FIGS. 5*b*-5*d* or retracted via sliding the ratchet switch 31 towards the base end of the comb component, as shown in FIGS. 6*b*-6*d*. As an example, hollow compartment 32, ratchet switch 31, and sectioning component 8 may be disposed on the outer side of the comb component, which may be advantageous as it may allow a stylist to easily manipulate the ratchet switch 31 with their thumb.

FIGS. 6*a*-6*d* illustrate an embodiment of a comb component 14 wherein sectioning component 8 is integrated with the comb component 14 and the sectioning component 8 is shown in a retracted position, according to an aspect. As shown in FIG. 6*c*, the ratchet switch 31 may slide along a ratcheting track, such that the ratcheting track 33 may hold the ratchet switch 31 in place. As an example, the embodiment of a hair styling tool 1 shown in FIGS. 5*a*-5*d* may be the same as the embodiment shown in FIGS. 6*a*-6*d*.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A hair styling tool comprising:

a glove component having a glove body and a plurality of protective fingertips;

a comb component having:

a base segment comprising a first ring configured to engage with a user's finger;

a tip segment pivotally attached to the base segment, the tip segment comprising a second ring configured to engage with the user's finger, wherein the base segment and tip segment are configured to cover a posterior surface of the user's finger while following the curvature of the user's finger;

a first set of teeth attached to the base segment and a second set of teeth attached to the base segment, wherein the first set of teeth and the second set of teeth are oriented in opposite directions and are disposed on different planes;

a hollow compartment nested within the comb component;

a ratcheting track disposed on the comb component;

a sectioning component nested within the hollow compartment, the sectioning component having a tip; and a ratchet switch attached to the sectioning component and engaged with the ratcheting track, wherein the ratchet switch is configured to be slid along the ratcheting track to selectively extend the sectioning component from the hollow compartment.

2. A hair styling tool comprising:

a comb component having:

a base segment configured to attach to a user's finger and a tip segment pivotally attached to the base segment;

a first set of teeth attached to the base segment and a second set of teeth attached to the base segment, wherein the first set of teeth and the second set of teeth are oriented in opposite directions and are disposed on different planes;

a hollow compartment nested within the comb component;

a ratcheting track disposed on the comb component;

a sectioning component nested within the hollow compartment, the sectioning component having a tip; and a ratchet switch attached to the sectioning component and engaged with the ratcheting track, wherein the ratchet switch is configured to be slid along the ratcheting track to selectively extend the sectioning component from the hollow compartment.

3. The hair styling tool of claim 1, wherein the protective fingertips are adapted to be selectively removed from the glove body.

4. The hair styling tool of claim 1, wherein the glove component is made of silicon.

5. The hair styling tool of claim 1, wherein the sectioning component is removable.

6. The hair styling tool of claim 2, wherein the teeth of the first and second sets of teeth are rectangle shaped.

7. The hair styling tool of claim 2, wherein the comb component is interchangeable.

* * * * *